US006540274B2

(12) United States Patent
Bates et al.

(10) Patent No.: US 6,540,274 B2
(45) Date of Patent: Apr. 1, 2003

(54) SLIDE

(75) Inventors: Peter K. Bates, Framingham, MA (US); Thor Hendrickson, London (GB); Dario L. Pompeii, Colorado Springs, CO (US)

(73) Assignee: Schlage Lock Company, Indianapolis, IN (US)

( * ) Notice: Subject to any disclaimer, the term of this patent is extended or adjusted under 35 U.S.C. 154(b) by 0 days.

(21) Appl. No.: 09/792,181

(22) Filed: Feb. 23, 2001

(65) Prior Publication Data

US 2002/0117866 A1 Aug. 29, 2002

(51) Int. Cl.[7] ..... E05B 3/08

(52) U.S. Cl. ..... 292/336.5; 292/DIG. 52; 292/DIG. 64; 292/169.23; 292/336.3; 70/472

(58) Field of Search ..... 292/DIG. 52, 358, 292/336.3, 336.5, 169, 170, 165, 163, 164, 167, DIG. 64, 169.23, 359, 347; 70/224, 467, 472, 215, 468–480

(56) References Cited

U.S. PATENT DOCUMENTS

| | | | | |
|---|---|---|---|---|
| 1,834,223 A | | 12/1931 | Rymer | |
| 2,738,666 A | | 3/1956 | Tornoe | |
| 3,823,585 A | | 7/1974 | Spon | |
| 4,333,324 A | * | 6/1982 | Dietrich et al. | 292/172 |
| 4,615,549 A | | 10/1986 | Couture | |
| 4,838,053 A | | 6/1989 | Shen | |
| 4,957,315 A | | 9/1990 | Lin | |
| 4,998,760 A | | 3/1991 | Nixon, et al. | |
| 5,004,278 A | | 4/1991 | Kang et al. | |
| 5,056,835 A | | 10/1991 | Johnson | |
| 5,177,987 A | | 1/1993 | Shen | |
| 5,192,097 A | | 3/1993 | Su | |
| 5,216,908 A | | 6/1993 | Malvy | |
| 5,286,074 A | | 2/1994 | Lin | |
| 5,335,948 A | * | 8/1994 | Norton et al. | 292/169.23 |
| 5,364,139 A | | 11/1994 | Bergen et al. | |
| 5,484,179 A | | 1/1996 | Mader | |
| 5,551,736 A | | 9/1996 | Fann et al. | |
| 5,564,760 A | | 10/1996 | Mader | |
| 5,570,916 A | | 11/1996 | Mader | |
| 5,590,555 A | | 1/1997 | Kester et al. | |
| 5,598,726 A | | 2/1997 | Cordle | |
| 5,613,715 A | | 3/1997 | Kim | |
| 5,640,863 A | | 6/1997 | Frolov | |
| 5,657,653 A | | 8/1997 | Hensley et al. | |
| 5,765,412 A | | 6/1998 | Koskela et al. | |
| 5,816,086 A | | 10/1998 | Russell, IV | |
| 5,826,924 A | | 10/1998 | Huang | |
| 5,941,108 A | | 8/1999 | Shen | |
| 6,101,856 A | * | 8/2000 | Pelletier et al. | 70/223 |
| 6,189,351 B1 | * | 2/2001 | Eagan et al. | 292/DIG. 27 |
| 2001/0023600 A1 | * | 9/2001 | Pompeii | 70/224 |

* cited by examiner

*Primary Examiner*—Robert J. Sandy
*Assistant Examiner*—Dinesh Melwani
(74) *Attorney, Agent, or Firm*—Michael Best & Friedrich LLP

(57) ABSTRACT

A slide compartment for a hybrid lock architecture. The slide component comprises a U-shaped body portion and a plurality of independent retractors. At least one pair of slots are positioned near an open end of said U-shaped body for attachment of a drawbar of a door latch assembly of the hybrid lock assembly. The hybrid lock assembly comprises a chassis assembly mounted in a bore of said door. A door latch assembly is operably connected to the slide component housed in the chassis assembly for retraction and extension of a bolt. A handle is mounted on a spindle on each side of the chassis assembly. Rotational motion of either handle is converted to linear motion within the chassis assembly at the slide interface in order to retract the bolt of the door latch assembly.

16 Claims, 13 Drawing Sheets

SLIDE

TECHNICAL FIELD

This invention relates generally to lock assemblies used to secure doors. More particularly, the present invention relates to a slide component developed for a hybrid lock architecture designed to incorporate the functionality of a cylindrical lock architecture with the ease of installation of a tubular lock architecture.

BACKGROUND OF THE INVENTION

There are currently two main types of lock architectures in widespread use today. These lock architectures are typically known as the cylindrical lock and the tubular lock designs. Each of these designs has advantages and disadvantages in comparison to the other.

While there are variations, traditionally, a cylindrical lock consists of a chassis, an inside mounting plate, an outside mounting plate and rose, an inside rose, a fixed backset latch, an inside and outside knob/lever, and mounting screws. The fundamental workings of the cylindrical lock provide the conversion of rotational motion of the knob/lever to linear motion—within the chassis housing—to retract the latch. The typical cylindrical lock architecture uses a drawbar occupying the axis of the latch bore. The cylindrical lock architecture typically is more expensive to manufacture, but allows more functional variations than a tubular lock and generally provides better security. The chassis has a fixed spindle-end to spindle-end length which easily accommodates a push-button locking mechanism, however this also results in a varying distance from the end of the knob/lever to the surface of the door when used with different door thicknesses. Installation of a cylindrical lock is generally more complicated than that of a tubular lock. During installation of the cylindrical lock, the inside knob/lever, rose, and mounting plate need to be removed. The chassis needs to be centered in the door by adjusting the outside rose. Additionally, the design constraints inherent in the cylindrical architecture make it impossible to have a dual backset latch which does not require some type of adjustment. Where available, these adjustable backsets used in cylindrical locks are failure-prone and inferior to fixed backset latches.

A tubular lock architecture traditionally consists of an inside chassis complete with a rose and a knob/lever attached, an outside chassis also complete with a rose and a knob/lever attached, a latch, and mounting screws. This simple design allows for easy and quick installation of the tubular lock design with virtually no adjustment required. Due to its simplicity, the tubular architecture also provides a cost advantage over the cylindrical lock. The tubular lock design also provides a fixed distance from the surface of the door to the end of the lever even when used with different door thicknesses. The tubular lock architecture converts rotational motion of the knob/lever to linear motion within the latch in order to retract the latch. Accordingly, a drawbar occupies the axis of the latch bore. However, due to the edge bore of a door preparation, the amount of latch retraction is restricted. Other problems are found in that design constraints make it impossible to design a consistently functioning push button lock because of the chassis datum on the surface of the door. Since the door thickness variation is considerably greater than the push button linear travel, no direct means are available to provide a secure consistent locking action. The tubular lock architecture is also generally less secure than a cylindrical lock architecture.

Accordingly, there remains a need in the art for a lock architecture which combines the advantages of both the tubular lock architecture and the cylindrical lock architecture along with other advantages, while minimizing or removing the limitations existing in each of the prior art designs. Accordingly, a suitable alternative is provided including features more fully disclosed hereinafter.

SUMMARY OF THE INVENTION

It is therefore an object of the present invention to provide a slide component for a new lock architecture configuration designed to incorporate the functionality of a cylindrical lock architecture with the ease of installation of a tubular lock architecture. These and other improvements are provided by a slide component comprising a U-shaped body portion. The slide also incorporates a plurality of independent retractors and at least one pair of retaining members, positioned near an open end of the U-shaped body for attachment of a drawbar of a door latch assembly of the lock assembly.

It is a further object of the present invention to provide a new lock architecture configuration utilizing the slide member which is designed to incorporate the functionality of a cylindrical lock architecture with the ease of installation of a tubular lock architecture. These and other improvements are provided by a lock assembly for a door comprising a chassis assembly mounted in a bore of the door and a door latch assembly operably connected to a slide member of the chassis assembly for retraction and extension of a bolt. A handle is mounted on a spindle on either side of the chassis assembly. Rotational motion imparted on one of the handles is converted to linear motion within the chassis assembly at the slide interface in order to retract the bolt of the door latch assembly.

DETAILED DESCRIPTION OF THE DRAWINGS

Figure 1:
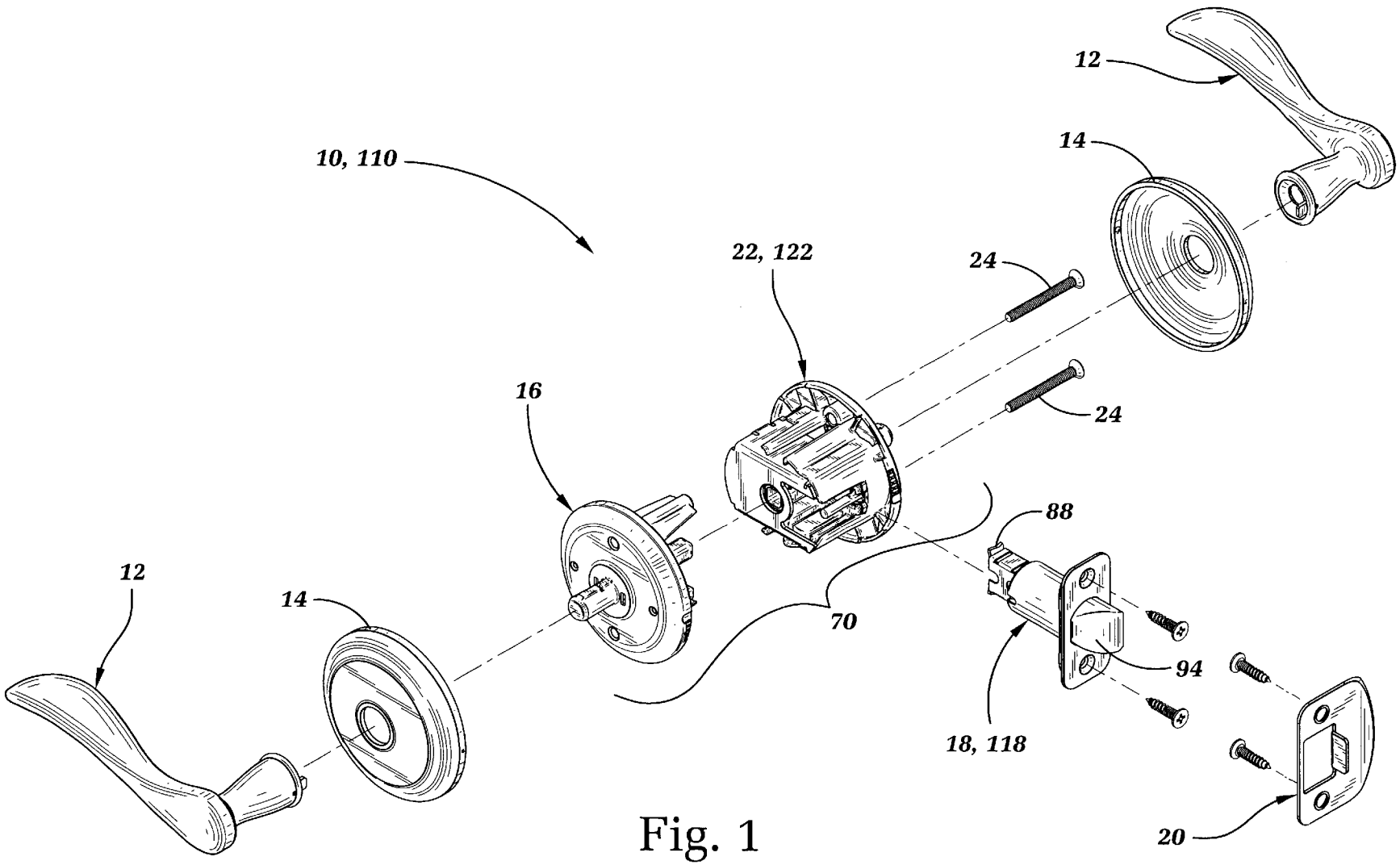
FIG. 1 is an exploded perspective view of an embodiment of the lock architecture of the present invention.

Referring now to the drawings, wherein similar reference characters designate corresponding parts throughout the several views, there is generally indicated at 10 a hybrid lock architecture of the present invention (the actual configuration shown includes a rose locking feature which is described in an alternate embodiment which is discussed in detail below) utilizing a slide component 50 of the present invention. As shown in FIG. 1, the hybrid lock architecture 10 comprises an outside chassis assembly 16, a latch assembly 18, a strike plate assembly 20, an inside chassis assembly 22, mounting screws 24, door handles or knob/lever assemblies 12, and roses 14. These pre-assembled components provide simple "hands off" assembly of the hybrid lock 10 in a prepared door similar to a tubular lock assembly. The combination of inside chassis assembly 22, 122 and outside chassis assembly 16 form lock architecture chassis assembly 70. Inside chassis assembly 22 and outside chassis assembly 16 telescopically engage each other in a manner allowing axial movement, but in an interlocking manner preventing relative rotational movement the inside chassis assembly component inner cam 209 and the outside chassis assembly 16. The hybrid lock 10 also has a fixed distance from the handle to the door as in the tubular lock assembly, with adjustment accommodated between the outside chassis assembly 16 and inside chassis assembly 22 via telescoping of tubular components. The hybrid lock architecture 10 is versatile and can accommodate a rose locking feature, an axial push button locking mechanism, a dual backset latch attachment, and/or a key cylinder assembly, as well as various field modifications which are discussed in detail below. The hybrid lock architecture 10 also uses standard base parts across multiple configurations which enables lower production costs of the multiple configurations, providing a cost effective design.

Figure 2:
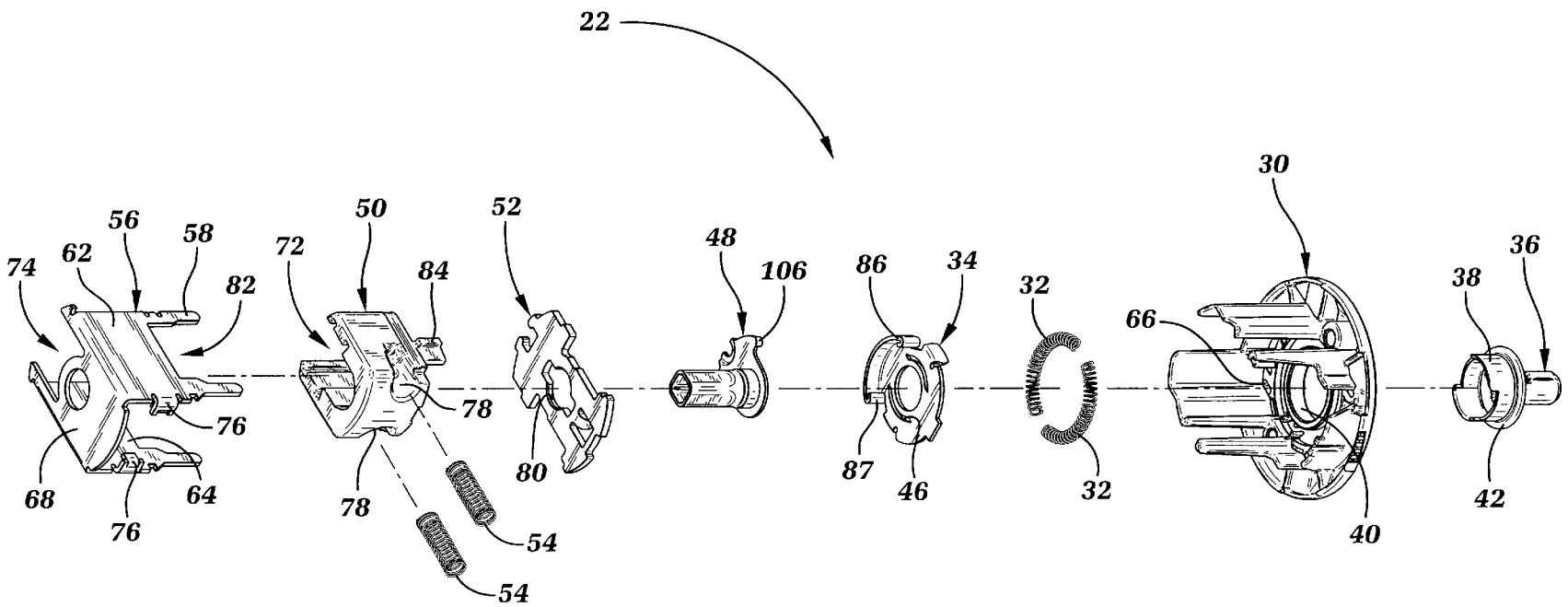
FIG. 2 is an exploded perspective view of the inside chassis assembly of an embodiment of the lock architecture of the present invention as shown in FIG. 1.

The details of each component assembly will now be discussed in detail. Referring now to FIG. 2, inside chassis assembly 22 is shown in an exploded manner. Inside chassis assembly 22 comprises an inside housing 30 which mates against the inside surface of the door, not shown, and fits into a bore in the door. At least one lever spring 32 is held in place against inside housing 30 by a main retractor 34. In the embodiment shown, two lever springs 32 are shown which, in conjunction with the main retractor 34, are secured to the inside housing by stepped spindle 36. Stepped spindle 36 comprises at least one tanged portion 38 which extends through a centrally located aperture 40 of inside housing 30 and a flange portion 42 which registers against the exterior surface 44 of inside housing 30. The at least one tanged portion 38 of stepped spindle 36 extends through a mating slot 46 in main retractor 34 and staked in a manner securing the attached parts. Any suitable attachment is contemplated such as a retaining ring, welding, adhesive, etc. Other suitable configurations to attach stepped spindle 36 to main retractor are contemplated. The spindle 36 is rotatable within inside housing 30, however lever springs 32 are positioned with one end biased against inside housing 30 and the other end biased against main retractor 34 such that the spindle 36 will return to a neutral position when a restraining force is removed, such as a user letting go of the lever/knob assembly 12.

Inside chassis assembly 22 further comprises an inner retractor 48, locking plate 52, slide 50, and at least one slide spring 54, all of which are attached to inside housing 30 by a slide cage 56. Slide cage 56 may be attached to inside housing 30 by tangs 58 extending from a first cage surface 62 and from a second cage surface 64. The tangs 58 are insertable into mating slots 66 formed in inside housing 30. Other forms of attachment between the slide cage 56 and inside housing 30 are also contemplated and within the scope of the invention. In the embodiment shown, upper cage surface 62 and lower cage side 64 are generally parallel to each other and connected by a generally U-shaped body portion 68 which is generally perpendicular to cage sides 62 and 64. U-shaped slide 50 slidably fits within cage 56. Slide 50 is oriented within cage 56 such that an open end 72 of slide 50 is oriented in the same direction as an open end 74 of body portion 68. Slide springs 54 are mounted on spring guide tabs 76 extending toward each other and perpendicularly from each cage side 62, 64. In an assembled configuration, slide springs 54 mate with self retaining springs seats 78 formed within slide 50 in a manner biasing slide toward end 74 of cage 56.

Figure 3:
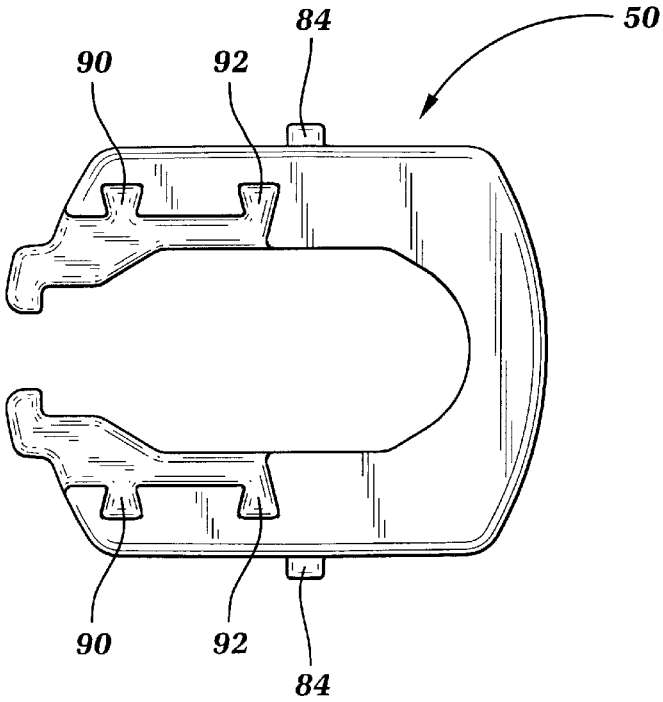
FIG. 3 is a side elevational view of the slide element of the inside chassis assembly as shown in FIG. 2.
Figure 4:
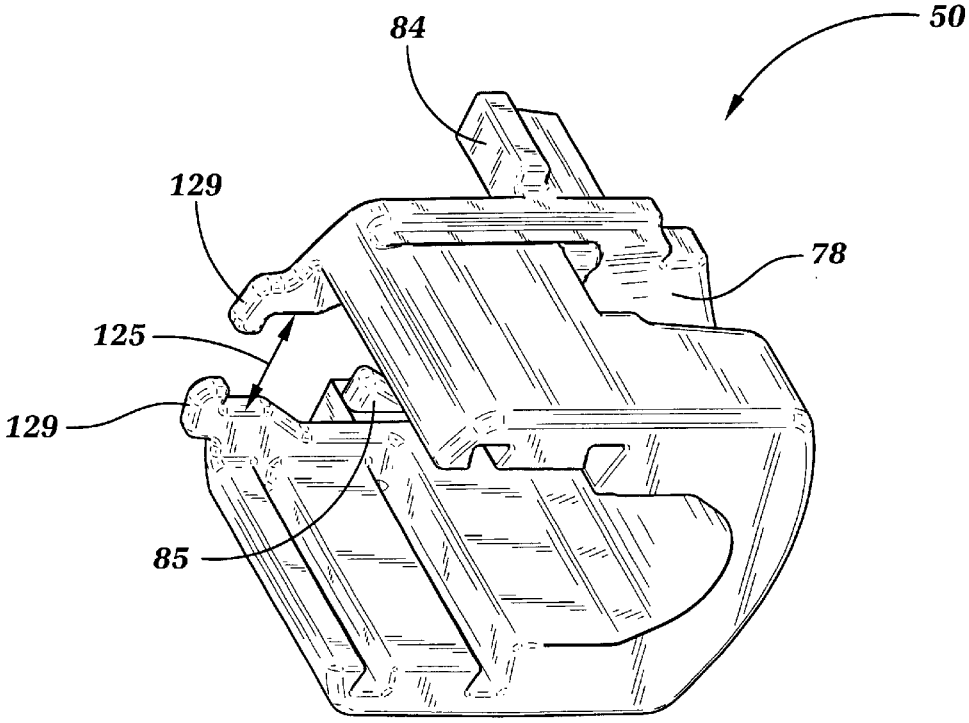
FIG. 4 is a perspective view of the slide element of the inside chassis assembly as shown in FIG. 2.

Lock plate 52 rotatingly mates with inner retractor 48 which is positioned through an aperture 80 in lock plate 52. The assembled lock plate 52 and inner retractor 48 are positioned over slide 50 positioned within cage 56 on a tanged side 82 of slide cage 56. In the assembled configuration, lock plate 52 is generally parallel to U-shaped cage body portion 68 and generally perpendicular to upper and lower cage sides 62 and 64, respectively. Slide 50 has retractor extensions 84 extending therefrom which are positioned within a raised arcuate portion 86 of main retractor 34. The arcuate portion 86 has ends 87 which engage extensions 84 upon rotation of main retractor 34 in either direction thereby causing slide 50 to slide away from the open end 74 of U-shaped body portion 68 of cage 56. Referring to FIGS. 1, 3 and 4, latch assembly 18 includes a drawbar 88 which mates within a first pair of slots 90, or a second pair of slots 92. Thus, rotational motion of the knob/lever assembly 12, causing rotation of main retractor 34, is converted to lateral movement of the slide 50. Lateral movement of the slide 50 results in retraction of a bolt 94 attached to the drawbar 88 of latch assembly 18. Conversely, when the rotational force on the main retractor 34 is released, springs 32 cause the main retractor 34 to return to its original position which allow slide springs 54 to bias slide 50 towards the open end 74 of cage 56. This enables the spring biased drawbar to return to an extended position, in turn causing bolt 94 to return to an extended or latched position.

Figure 5:
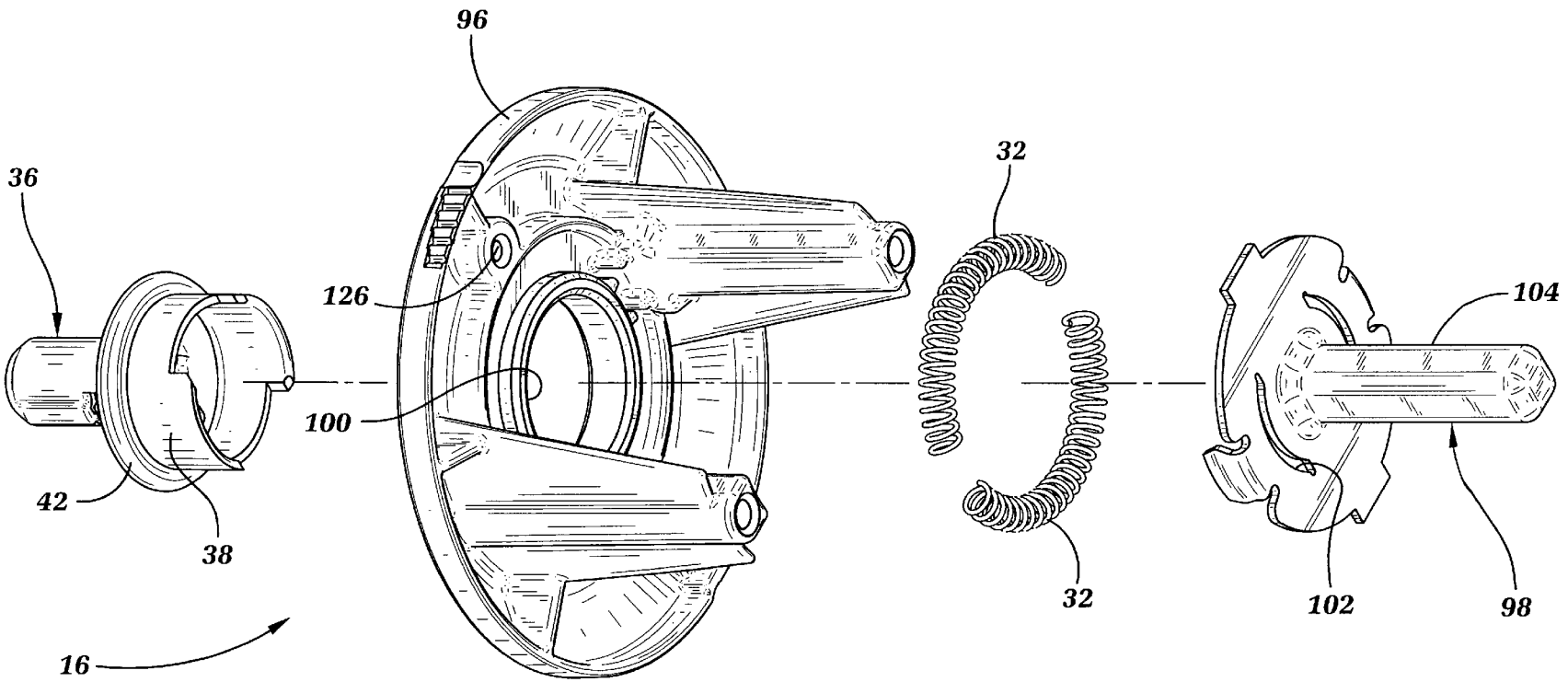
FIG. 5 is an exploded perspective view of the outside chassis assembly of an embodiment of the lock architecture of the present invention as shown in FIG. 1.

Outside chassis assembly 16 is shown in more detail in FIG. 5. Similarly to inside chassis assembly 22, outside chassis assembly 16 comprises an outside housing 96 which mates against the outside surface of the door, not shown, and fits into a bore in the door, and at least one lever spring 32, held in place against the outside housing 96 by inner retractor driver 98. The lever springs 32 and inner retractor driver 98 are secured to the outside housing 96 by stepped spindle 36. Stepped spindle 36 may comprise at least one tanged portion 38 which extends through a centrally located is aperture 100 of outside housing 96 and a flange portion 42 which registers against the outer surface 144 of outside housing 96. The at least one tanged portion 38 of stepped spindle 36 extends through a mating slot 102 in inner retractor driver 98 and staked in a manner securing the attached parts. Any suitable attachment is contemplated such as a retaining ring, welding, adhesive, etc. Again other suitable configurations to attach spindle 36 to driver 98 are contemplated. The spindle 36 is rotatable within outside housing 96, however lever springs 32 are positioned with one end biased against outside housing 96 and the other end biased against inner retractor driver 98 such that the spindle 36 will return to a neutral position when a restraining force is removed, such as a user letting go of the lever/knob assembly 12. Inner retractor driver 98 includes a driver bar portion 104. When outside chassis assembly 16 is attached to inside chassis assembly 22, driver bar portion 104 of inner retractor driver 98 mates within inner retractor 48 such that rotation of one causes rotation of the other. As previously described, slide 50 has retractor extensions 84 extending therefrom which are biased against a retractor portion 106 of inner retractor 48. Rotation of inner retractor 48 in either direction causes slide 50 to slide away from the open end 74 of U-shaped body portion 68 of cage 56, thus retracting bolt 94 attached to the drawbar 88 of latch assembly 18. Conversely, when the rotational force on the inner retractor 48 is released, springs 32 cause the inner retractor 48 and inner retractor driver 98 to return to their original positions which allow slide springs 54 to bias slide 50 towards the open end 74 of cage 56. This enables the spring biased drawbar to return to an extended position, in turn causing bolt 94 to return to an extended or latched position.

When lock architecture 10 is used on non-standard thickness doors, either thinner or thicker, outside chassis assembly 16 can move inward or outward in relation to inside chassis assembly 22 as driver bar portion 104 of inner retractor driver 98 is able to slide inward or outward in a telescopic manner with respect to inner retractor 48 and still maintain a co-rotating connection with inner retractor 48. This makes any adjustment of the lock unnecessary. Conversely, a cylindrical architecture lock chassis has a fixed spindle-end to spindle-end length which results in a varying distance from the end of the lever to the surface of the door when used with different door thicknesses. The combination of inside chassis assembly 22 and outside chassis assembly 16 form lock architecture chassis assembly 70. Accordingly, with lock architecture 10, the distance between the door handle 12 and the door (not shown) will always be fixed distance regardless of variations in the door thicknesses.

Focusing now on FIGS. 3 and 4, slide 50 will be discussed in greater detail. Slide 50 provides the conversion of rotational movement into lateral movement of the drawbar 88 through the unique configuration of the cam surfaces of slide body 50. Slide 50 comprises dual, co-planar independent retractor extensions 84. This allows slide 50 to react to rotation of main retractor 34 or inner retractor 48 in either a clockwise or counter-clockwise direction. Slide 50 comprises self-retaining spring seats 78 which allow for easy assembly of the slide 50 within cage 56. The U-shaped body configuration of slide 50 also allows clearance throughout its stroke for associated parts to occupy the central rotational axis between the lever/knob assemblies 12 of lock architecture 10. Another aspect of slide 50 are two pairs of interlocking drawbar retaining members, such as slots 90, 92 which allow a dual backset feature. Although slots 90, 92 are shown in the embodiment, other suitable retaining members are contemplated, such as mechanical fasteners or the like. This enables latch assembly 18 to be attached to accommodate different standard backset distances such that no adjustment is required. A dual backset feature also enables slide 50 to be used with a convertible latch assembly 18 which will be discussed in detail below.

Figure 6:
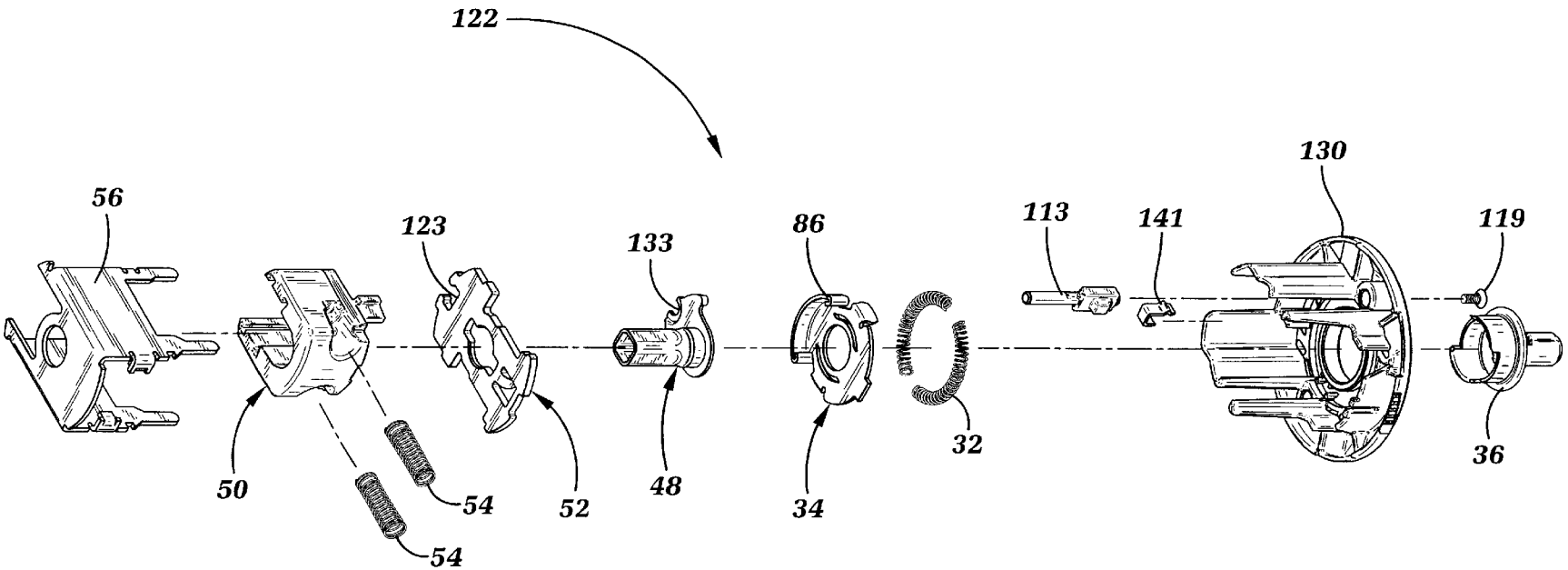
FIG. 6 is an exploded perspective view of another embodiment of the lock architecture of the present invention including a rose locking feature.
Figure 7:
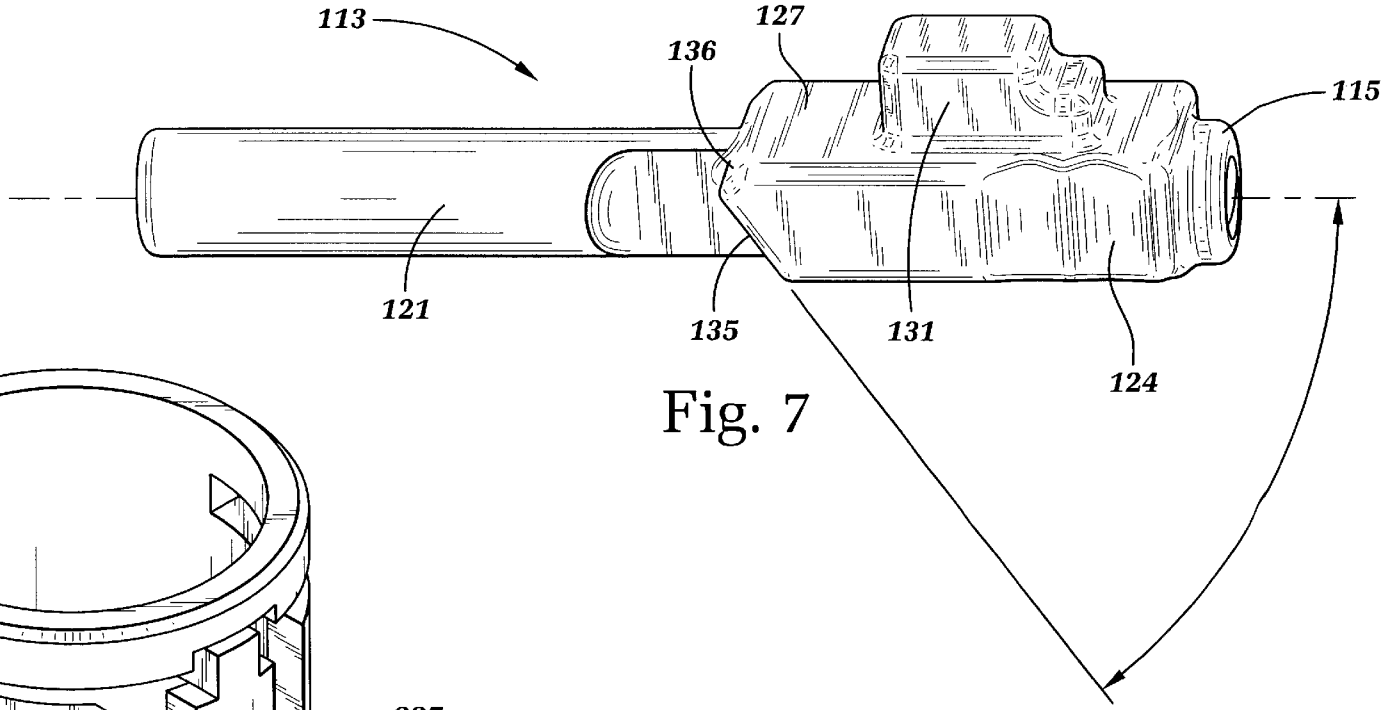
FIG. 7 is a perspective view of a push button lock bar used in the rose locking feature in an embodiment of the lock architecture of the present invention as shown in FIG. 6.

In the first embodiment, lock architecture 10 was shown in a passage function configuration whereas rotation of door handle 12 from either the inside of the door or the outside of the door would retract the bolt 94 and open the door. In an alternate embodiment, lock architecture 110 provides a privacy configuration that includes an inside chassis assembly 122 including a rose locking mechanism 26 as shown in FIG. 6. Inside chassis assembly 122 is similar to inside chassis assembly 22 except that it further comprises rose locking feature 26 including a push button lock bar 113, shown in detail in FIG. 7, having a first end 115 which protrudes through an aperture 117 (not shown) in inside housing 130. Rose locking mechanism 26 of inside chassis assembly 122 also comprises a rose lock catch 141 which biasly engages one of a pair of depressions 124 located on intermediate portion 127 of push button lock bar 113 holding it in a selected position in either a locked or unlocked axial position. Rose lock catch 141 is held in place by being captured between inside housing 130 and lock plate 52. The first end 115 of push button lock bar 113 is internally threaded and mates with externally threaded decorative stem attached from the opposite side of inside housing 130. Second end 121 of push button lock bar 113 is generally formed as a rod which, when lock architecture 110 is assembled, extends through an opening 123 in lock plate 52 and a similarly configured opening 125 in slide 50 in a manner allowing slide 50 to move freely within cage 56. Push button lock bar 113 includes an intermediate locking portion 127 between first end 115 and second end 121. Push button lock bar 113 is held in place by intermediate locking portion 127 being captured between inside housing 130 and lock plate 52. Slide 50 includes two converging extensions 129, also referred to as push button lock bar retractors, on open end 72 as seen in FIG. 4. When a rose locking button (not shown) is depressed toward inside housing, push button lock bar 113 moves axially such that intermediate locking portion 127 engages slide 50 such that converging extensions 129 contact intermediate locking portion 127. Intermediate portion 127 includes an extension portion 131 which, when the rose locking feature is engaged, axially engages a slot 133 in inner retractor 48 in a manner preventing rotational movement of inner retractor 48, thus preventing the lock 110 from being operated from the outside of the door.

The rose locking mechanism 26 can be disengaged in several ways. The first method is by rotation of the inside door lever/knob 12 which rotates main retractor 34. The arcuate portion 86 of main retractor 34 engages extensions 84 on slide 50. Intermediate locking portion 127, as previously mentioned, engages slide 50. However, intermediate locking portion 127 has a first inclined leading cam surface 135 on the side adjacent converging extensions 129 of slide 50. As the slide 50 moves due to rotation of main retractor 34, converging extensions 129 engage first inclined leading cam surface 135 forcing push button lock bar 131 axially into an unlocked position. The second method of disengaging the rose locking feature 26 is by pushing a rod through an aperture 126 in the outside housing 96 and manually disengaging the push button lock bar 113 similar to that of a conventional cylindrical lock with a central push button locking mechanism. A third method is provided when the door is open when the rose locking mechanism 26 is engaged, closing the door will unlock the door when the lock is configured with a restoring feature (to be discussed in detail below). Essentially, when the door bolt hits the strike plate assembly 20, the latch assembly 18 forces the slide 50 to move. As the slide 50 moves, converging extensions 129 engage first inclined leading cam surface 135 forcing push button lock bar 131 axially into an unlocked position. Conversely, if a restoring feature is not used in the latch assembly 18, the door will remain locked when shut after engaging the rose locking feature 26. As can be seen, the rose locking mechanism 26 is completely contained in the inside chassis assembly 122. The rose locking feature does not depend on the distance between the inside chassis assembly 122 and the outside chassis assembly 16. Lock architecture 110 therefore provides the convenience of a rose locking mechanism 26 which is independent of varying door thicknesses and varying distances between door lever/knobs 12.

It is possible to accidentally engage push lock bar 113 into a locked position when the slide 50 is in a retracted bolt position. In such a case, push lock bar 113 will be automatically returned to a disengaged position when slide 50 returns to an extended bolt position to toward the U end 74 of cage 56. This is accomplished by converging extensions 129 of slide 50 engaging a second inclined leading cam surface 136 on intermediate portion 127 of push lock bar 113. As converging extensions 129 engage second cam surface 136, push lock bar 113 is forced rearward to a disengaged position.

Figure 8:
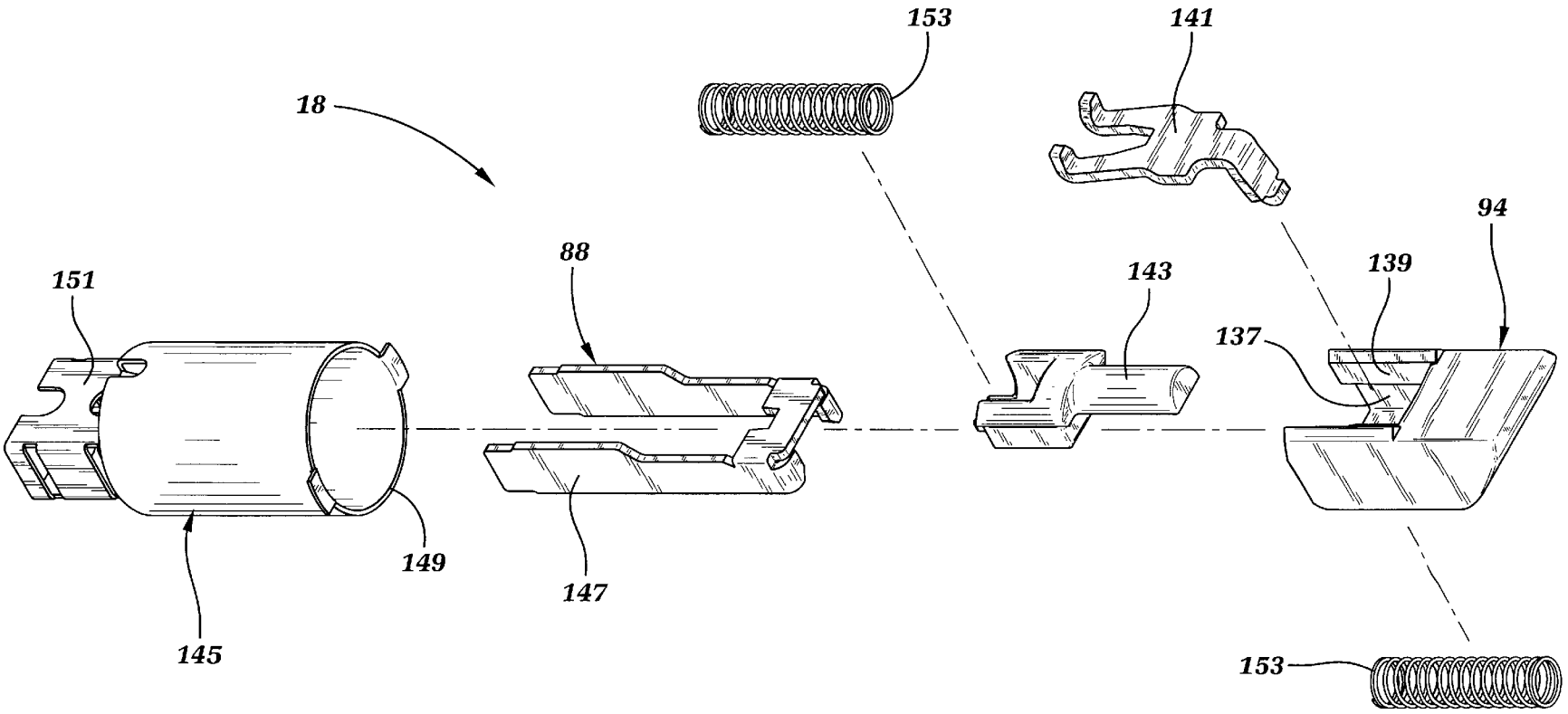
FIG. 8 is an exploded perspective view of a dead latch assembly of an embodiment of the lock architecture of the present invention as shown in FIG. 1.

Another embodiment of the present invention involves a convertible door latch assembly for use in both a non-locking function lock architecture and a privacy, or locking lock architecture configuration. The convertible door latch assembly can easily be converted from a dead latch configuration to a spring latch configuration. Each configuration can also be converted from a non-restoring to a restoring function. Referring now to FIG. 8, door latch assembly 18 is shown in an exploded manner in a dead latch configuration. Latch assembly 18 comprises bolt 94 and drawbar 88 slidably captured within a first slot 137 of bolt 94 by dead latch stop 141. A plunger 143 slidably positioned partially within a second slot 139 of bolt 94 is provided, along with a bolt housing 145. Drawbar 88 may be U shaped having legs 147. The U-shaped drawbar 147 allows greater latch retraction while providing clearance for other lock architecture assembly components. Bolt housing 145 has a first end 149 and a second end 151. The bolt 94/drawbar 88/dead latch stop 141/plunger 143 combination is attached to bolt housing 145 by inserting the drawbar legs 147 through first end 149 of bolt housing 145 until they extend beyond the second end 151 a bolt housing 145 and bending drawbar legs 147 outward. The bolt 94/drawbar 88 is biased by spring 153 into an extended position such that a portion of bolt 94 extends out of bolt housing 145. The plunger 143 is biased by spring 153 into an extended position such that a portion of plunger 143 extends out of bolt housing 145. Dead latch assembly 18 eliminates the typical dead latch stop, which is fixed to the stationary bolt housing, and replaces it with dead latch stop 141, which acts as a dynamic link between drawbar 88 and bolt 94. When the dead latch plunger 143 is depressed, the dead latch stop 141 engages the bolt housing 145 preventing the bolt 94 from being depressed. When the drawbar 88 is activated by the slide 50 in the lock chassis, the interface of the drawbar 88 and dead latch stop 141 causes the dead latch stop 141 to swing away from the stationary bolt housing 145 allowing the retraction of the bolt 94.

Figure 9:
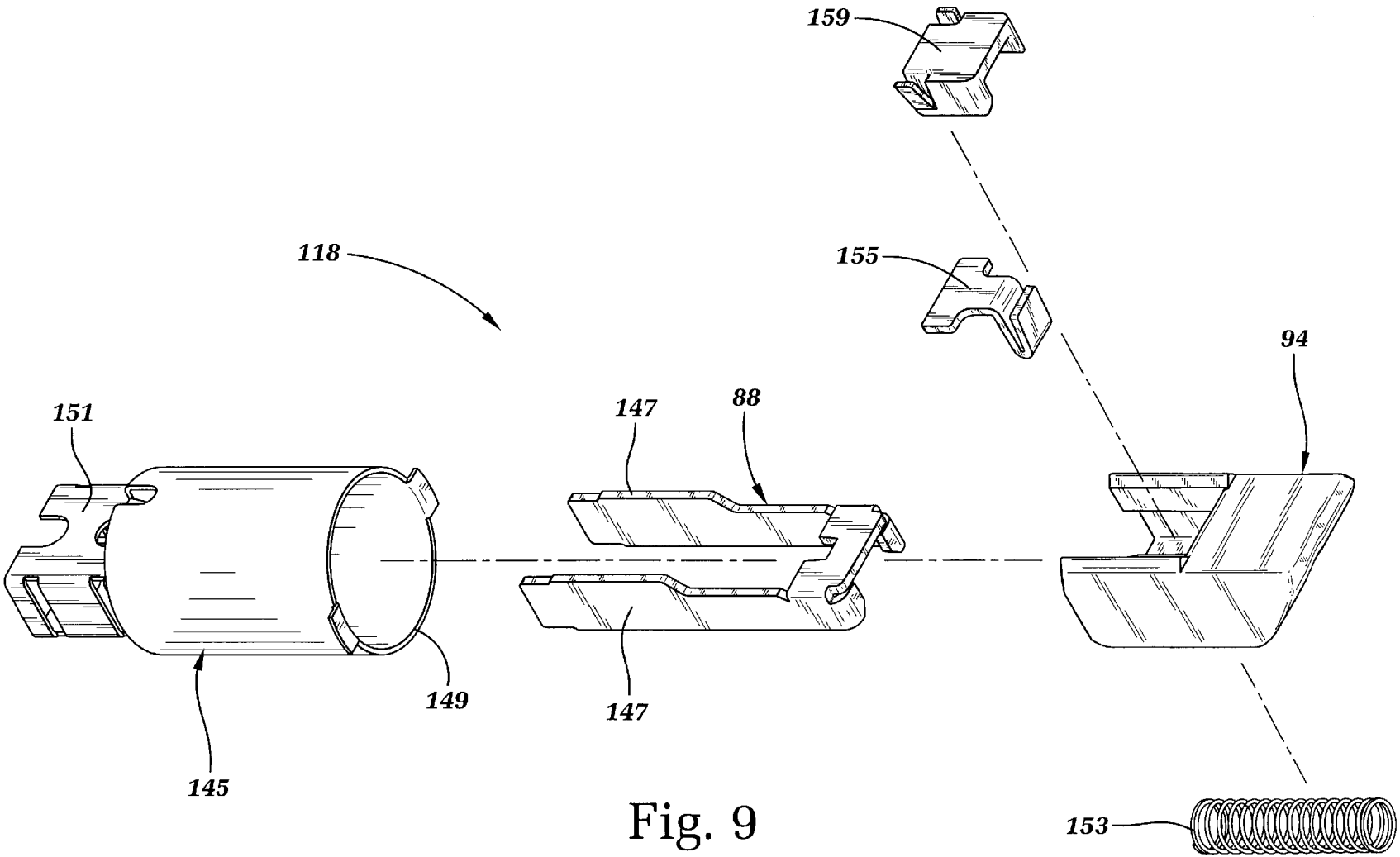
FIG. 9 is an exploded perspective view of a spring latch assembly of an embodiment of the lock architecture of the present invention as shown in FIG. 1 also showing the optional restore mechanism of another embodiment of the present invention.

Referring now to FIG. 9, door latch assembly 118 is shown in an exploded manner in a spring latch configuration. Latch assembly 118 comprises a bolt 139, a drawbar 141 slidably captured within a slot 155 of bolt 139 by pull 153, and a bolt housing 145. The bolt 139/drawbar 141/pull 153 combination is attached to bolt housing 145 by inserting the drawbar legs 147 through first end 149 of bolt housing 145 until they extend beyond the second end 151 a bolt housing 145 and bending drawbar legs 147 outward. The bolt 139/drawbar 141 is biased by spring 153 into an extended position such that a portion of bolt 139 extends out of bolt housing 145 in a standard manner. Door latch 118 is easily converted from a spring latch 118 to a dead latch 18 in the manufacturing process or in the field by disassembling the latch assembly 118 and replacing pull 155 with dead latch stop 141 and adding plunger 143 and spring 153. Conversely, door latch assembly 18 is easily converted from a dead latch 18 to a spring latch 118 in the manufacturing process or in the field by disassembling the latch assembly 118 and replacing dead latch stop 141 with pull 155 and removing plunger 143 and plunger spring 153.

In both door latch assemblies, 18,118, depressing the bolt will not result in movement of drawbar 88 as both door latch assemblies are in a non-restoring configuration. In other words, when an open door is locked—when shut—the door will remain in a locked state. In another embodiment, the present invention provides an inactive component referred to as a restore component 159 as shown in FIG. 9 to convert the latch from a non-restoring configuration to a restoring configuration. The restore component 159 is also easily removed to convert the latch from a restoring configuration to a non-restoring configuration. Restore component 159 is positioned within slot 139 and is of such physical dimension that restore component 159 restricts the movement of drawbar 88 within slot 139. When door latch assembly 18, 118, are configured with restore component 159, depressing the bolt 94 results in movement of drawbar 88. This action causes slide 50 to move and, if the door is in a locked state, with causes the door to unlock.

Figure 10:
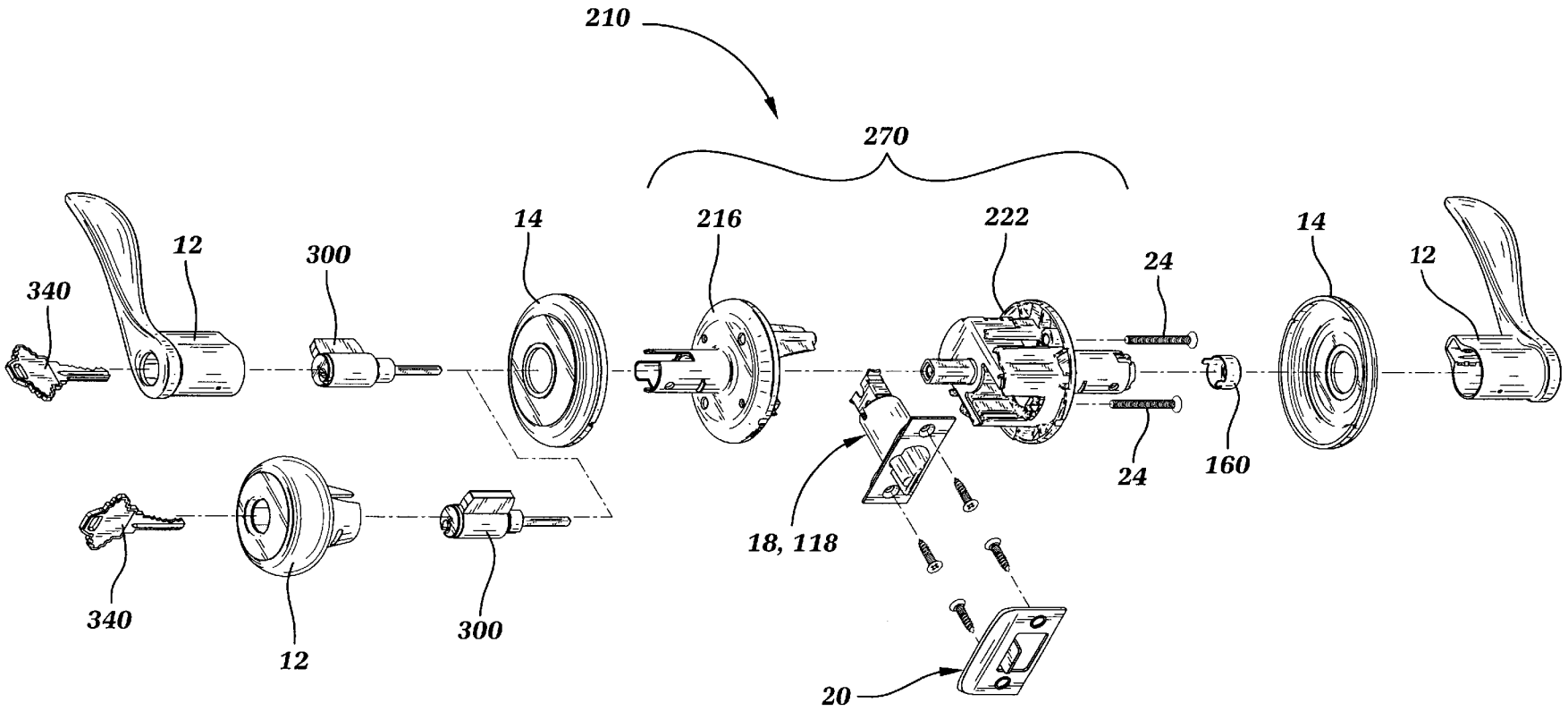
FIG. 10 is an exploded perspective view of another embodiment of the lock architecture of the present invention.

In another embodiment of the present invention as shown in FIG. 10, lock architecture 210 comprises a push button locking mechanism. Lock architecture 210 comprises an outside chassis assembly 216, a latch assembly 18, a knob/lever cylinder assembly 300, a key 340, a strike plate assembly 20, an inside chassis assembly 222, mounting screws 24, door handles or knob/lever assemblies 12 (shown as both a lever and knob configuration on the inside chassis assembly 222 side), push button 160, and roses 14 in a similar manner as that shown in FIG. 1 with relation to lock architecture 10. The combination of inside chassis assembly 222 and outside chassis assembly 216 form lock architecture chassis assembly 270. Inside chassis assembly 222 and outside chassis assembly 216 telescopically engage each other in a manner allowing axial movement, but in an interlocking manner preventing relative rotational movement of the inside chassis assembly 222 with respect to the outside chassis assembly 216, and vice versa.

Figure 13:
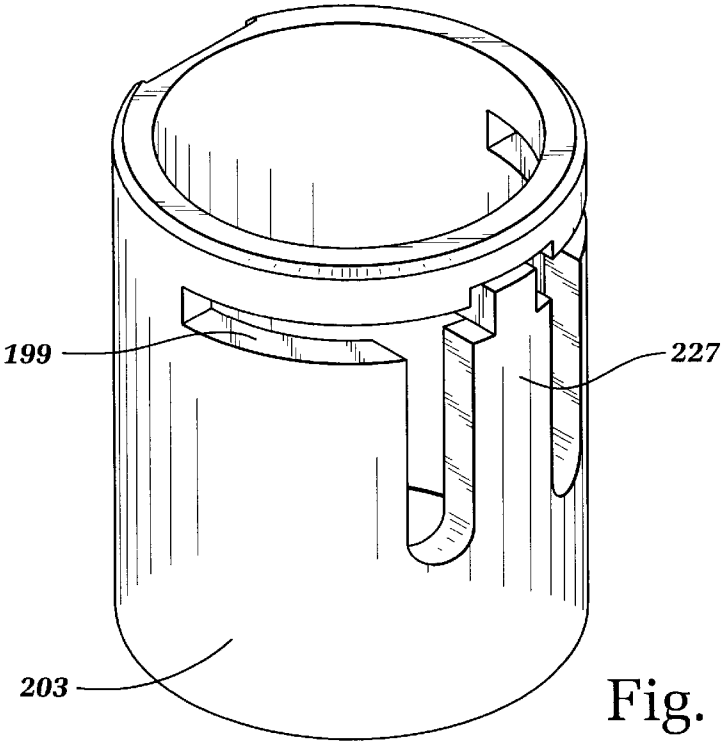
FIG. 13 is a perspective view of a catch spring element of the inside chassis assembly of an embodiment of the lock architecture of the present invention as shown in FIG. 10.
Figure 11:
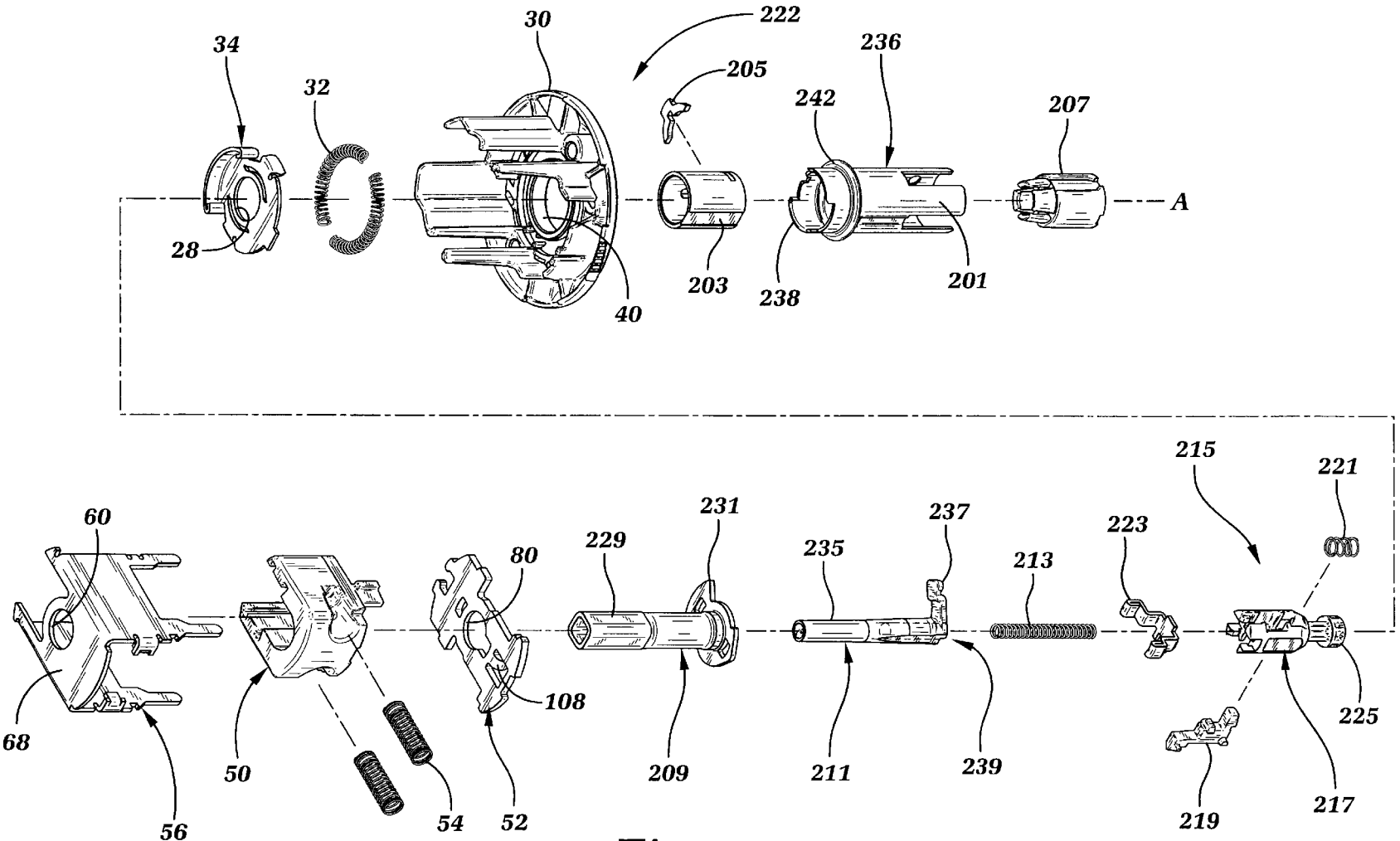
FIG. 11 is an exploded perspective view of the inside chassis assembly of an embodiment of the lock architecture of the present invention as shown in FIG. 10 featuring a push button locking mechanism.
Figure 12:
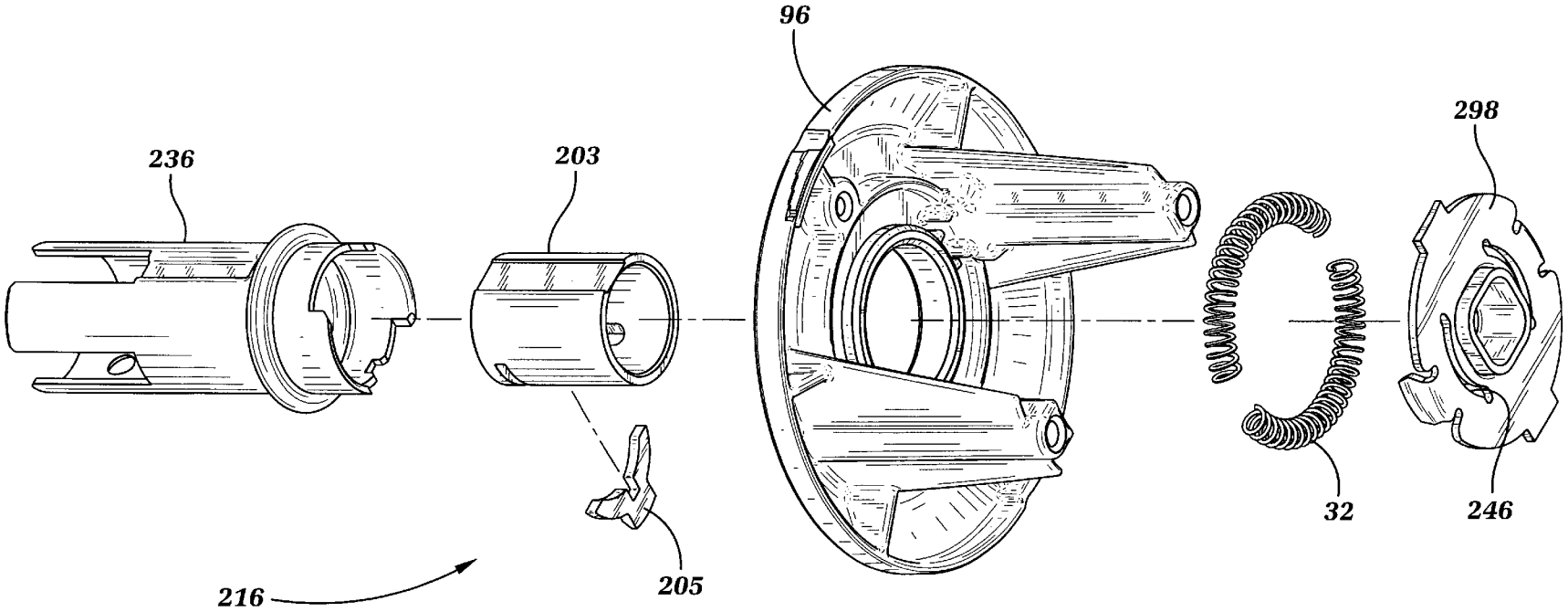
FIG. 12 is an exploded perspective view of the outside chassis assembly of an embodiment of the lock architecture of the present invention as shown in FIG. 10.

Lock architecture 210 is formed by using a combination of previously described components with new components as shown in FIGS. 11 and 12. Referring now to FIG. 11, inside chassis assembly 222 is shown in an exploded manner. Inside chassis assembly 222 comprises inside housing 30, at least one lever spring 32, held in place against the inside housing 30 by main retractor 34. The lever springs 32 and the main retractor 34 are secured to the inside housing by stepped spindle 236. Stepped spindle 236 comprises at least one tanged portion 238 which extends through a centrally located aperture 40 of inside housing 30 and a flange portion 242 which registers against the exterior surface 44 of inside housing 30. The at least one tanged portion 238 of stepped spindle 36 extends through mating slot 46 in main retractor 34 and staked in a manner securing the attached parts. Spindle 236 is typically manufactured as a drawn tube which provides a superior form of roundness and prevents flat spots and seams characterized by typical tubular lock spindles. The spindle 236 is rotatable within inside housing 30, however lever springs 32 are positioned with one end biased against inside housing 30 and the other end biased against main retractor 34 such that the spindle 236 will return to a neutral position when a restraining force is removed, such as a user letting go of the lever/knob assembly 12. In a push button locking mechanism, the push button 160 occupies the central rotational axis A of the lever/knob. Accordingly, spindle 236 comprises a tubular extension portion 201. A catch spring 203 is positioned within tubular extension portion 201 and engages knob catch 205. Catch spring 203 and knob catch 205 enable the lever/knob assembly 12 to be placed over the tubular extension portion 201 and retained on spindle 236. Catch spring 203 comprises a tang portion 227 and a slot 199 as best shown in FIG. 13. Knob catch 205 is positioned within slot 199 and over tang portion 227 such that tang portion 227 biases knob catch 205 radially outward in a manner that knob catch 205 engages a corresponding slot (not shown) in the lever/knob assembly 12. Button carrier 207 is positioned within the end of tubular extension portion 201. A push button 160 engages button carrier 207 and extends from the lever/knob 12 in a standard manner. The button can be either a standard push button 160 or a standard push/turn button. Button carrier 207 is free to rotate when configured with a push button 160. When the lock 210 is configured with a push/turn button and a protrusion fixed to the spindle 236, it allows the operator to turn the button and block out the restoring function of the lock architecture 210.

Inside chassis assembly 222 further comprises previously disclosed elements slide 50, cage 56, slide springs 54 and locking plate 52. The push button locking feature of inside chassis assembly 222 comprises inner cam 209, key cam 211, push button spring 213, and locking catch assembly 215. Locking catch assembly 215 includes locking catch carrier 217, locking catch 219, locking catch spring 221, and locking wing 223. Locking catch assembly 215 has a head end 225 opposite locking wing 223. It is contemplated that two or more or all of the individual elements of locking catch assembly 215 can be consolidated into one, two, or three elements instead of the four shown. The locking catch assembly is inserted, head end 225 first, along central axis A through a central aperture 28 in main retractor 34 and through aperture 40 of inside housing 30 into the interior of spindle 236 such that locking catch 219 is depressed inward. Head end 225 is matingly captured by push button carrier 207. Inner cam 209 has a driver bar portion 229 at one end and a cam shaped flange portion 231 at the other end thereof. Driver bar portion 229 is positioned through aperture 80 in locking plate 52 and aperture 60 in cage body portion 68 such that flange portion 231 registers against locking plate 52. Key cam 211 comprises a rod portion 235 and an arm portion 237 at one end thereof. Inner cam 209 is hollow such that the rod portion 235 of key cam 211 is positioned within inner cam 209 such that arm portion 237 of key cam 211 generally registers against flange portion 231 of inner cam 209. Key cam 211 has a hollow central cavity 239. Push button spring 213 is positioned partially within central cavity 239 such that push button spring 213 biases locking catch assembly 215 axially toward push button carrier 207.

Lock architecture 210 also comprises outside chassis assembly 216 shown in FIG. 12 in an exploded perspective view. Outside chassis assembly 216 comprises outside housing 96, at least one lever spring 32, held in place against the outside housing 96 by inner cam driver 298. The lever springs 32 and the inner cam driver 298 are captured against outside housing 96 by stepped spindle 236. Stepped spindle 236 comprises at least one tanged portion 238 which extends through a centrally located aperture 100 of outside housing 96 and a flange portion 242 which registers against the exterior surface 44 of outside housing 96. The at least one tanged portion 238 of stepped spindle 236 extends through mating slot 246 in inner cam driver 298 and staked in a manner securing the attached parts. The spindle 236 is rotatable within outside housing 96, however, lever springs 32 are positioned with one end biased against inside housing 30 and the other end biased against inner cam driver 298 such that the spindle 236 will return to a neutral position when a restraining force is removed, such as a user letting go of the lever/knob assembly 12. Spindle 236 comprises a tubular extension portion 201. A catch spring 203 is positioned within tubular extension portion 201 and engages knob catch 205. Catch spring 203 and knob catch 205 enable the lever/knob assembly 12 to be placed over the tubular extension portion 201 and retained on spindle 236 as described above in relation to inner chassis assembly 222.

Figures 14, 15:
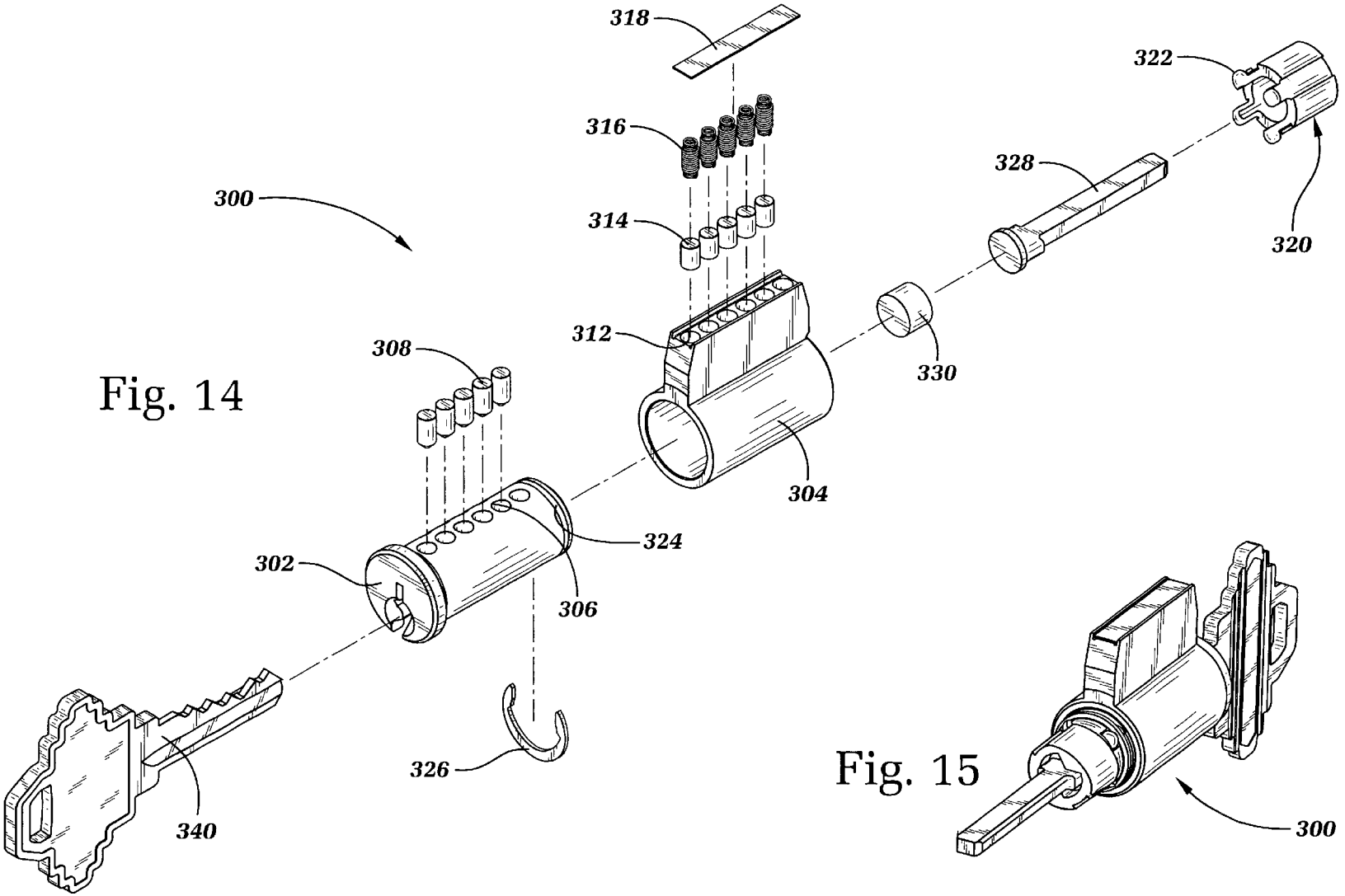
FIG. 14 is an exploded perspective view of a key cylinder assembly of another embodiment of the present invention.
FIG. 15 is an perspective view of the key cylinder assembly of another embodiment of the present invention as shown in FIG. 14.
Figure 16:
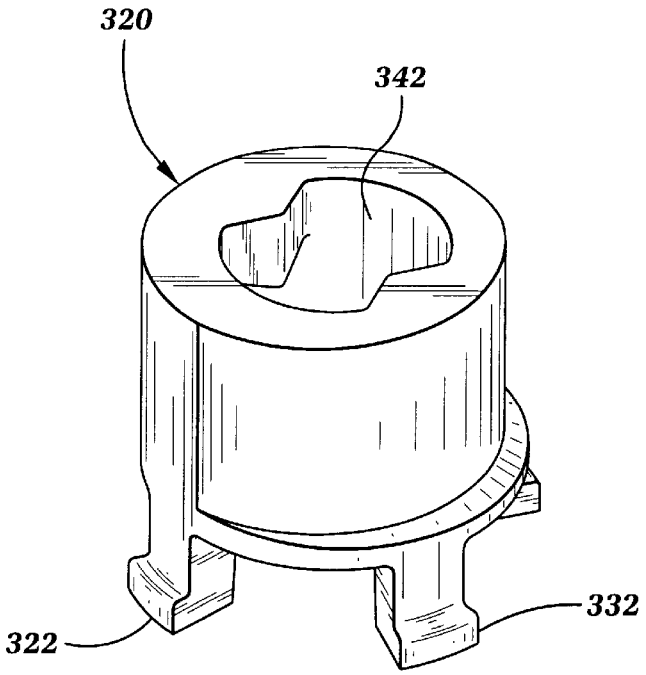
FIGS. 16 and 16A show perspective views of alternate cylinder drivers used in the key cylinder assembly of the embodiment of the present invention as shown in FIG. 14.

Referring now to FIGS. 14 and 15, a key cylinder assembly 300 is shown in an exploded perspective view and in an assembled perspective view, respectively. Key cylinder assembly 300 comprises cylinder plug 302, mating within cylinder body 304. Cylinder plug 302 includes a plurality of cylindrical apertures 306 which house a plurality of bottom cylinder pins 308. Cylinder body 304 includes a plurality of cylindrical apertures 312 which house a plurality of top cylinder pins 314, each biased toward cylinder plug 302 by springs 316 and retained by cylinder body cover 318. Key cylinder assembly 300 also comprises a cylinder driver 320 having a plurality of legs 322 that engage a plurality of mating holes 324 in the cylinder plug 302 and is held in place with a retaining ring 326. Cylinder driver 320 secures a driver bar 328 and a spacer 330 to the cylinder plug 302 and rotates the driver bar 328 when the cylinder plug 302 is rotated with key 340. The driver bar 328 comprises a "FIG. 8" cutout 342, best shown in FIG. 16, which prevents driver bar 328 from retracting the latch assembly 18 if the locking wing 223 fails. Driver bar 328 is generally oriented horizontally for both the knob and lever cylinders; therefore, the cylinder driver 320 and driver bar 328 rotate 90 degrees with respect to cylinder plug 302. In order to provide two positions for driver bar 328 orientation, one leg 332 of the plurality of legs 322 of cylinder driver 320 is larger than the other legs 322, and two slots 336 in the cylinder plug 302 are larger to accommodate larger leg 332. The large leg 332 of the cylinder driver 320 will only fit two positions, one for a knob and one a lever.

Figure 16A:
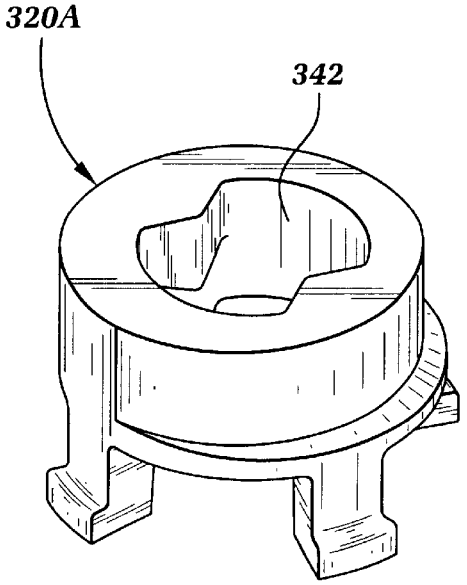

Knobs typically stand off from the door surface a greater distance than that of levers. Key cylinder assembly 300 is convertible, either in manufacturing or as a field replacement, in order to compensate for these differences. For smaller stand off distances typical of levers, spacer 330 can be removed and cylinder driver 320 replaced with a cylinder driver of a smaller height 320A as shown in FIG. 16A. In addition, the length of the driver bar 328 and cylinder driver 320 height can be modified to fit thinner doors and thicker doors (not shown).

Key cylinder assembly 300 is used to unlock exterior knob or lever door lock by rotating the key 340, cylinder plug 302, cylinder driver 320, and driver bar 328. Driver bar 328 mates with rod portion 235 of key cam 211 in a telescopic and co-rotating manner. This allows variations in set-off distance to be accommodated by the driver bar 328/key cam 211 interface. Rotation of key cam 211 causes arm portion 237 of key cam 211 to engage retractor extension 84 of slide 50. Movement of slide 50 retracts latch assembly 18, allowing the door to open. Movement of slide 50 also causes catch lock retraction extension 85 on retractor extension 84 to depress locking catch 219 of locking catch assembly 215 such that locking catch 219 no longer engages aperture 28 of main retractor 34. This allows push button spring 213 to bias locking catch assembly 215 axially away from inner cam 209 and return push button carrier 207 to an unlocked position under the biasing force of push button spring 213. Typically, the cylinder is oriented vertically in the knob lock, and horizontally in the lever lock due to the style and shape of the exterior designs.

When lock architecture 210 is in an unlocked condition, rotation of the outside knob/lever 12 rotates inner cam driver 298 as shown in FIG. 12. Inner cam driver 298 mates with inner cam 209 in a co-rotating manner. Rotation of inner cam 209 will cause flange portion of inner cam 209 to engage retractor extensions 84 of slide 50. Movement of slide 50 retracts latch assembly 18, allowing the door to open. To lock the door using the push button mechanism, the push button 160 is depressed, or depressed and turned, depending type of push button system utilized. This depression forces push button carrier 207 to move locking catch assembly 215 inward toward slide 50 allowing locking catch spring 221 to bias locking catch 219 to move radially outward such that a portion of locking catch 219 engages aperture 28 of main retractor 34 in a manner preventing locking catch assembly 215 from moving axially under the biasing force of spring 213 and returning to an unlocked position once the depressing force is removed. Wing lock 219 of locking catch assembly 215 engages at least one aperture 214 in flange portion of cam driver 209 in a manner preventing rotation of inner cam 209. Specifically, wing lock 219 comprises at least one locking extension which matingly engages at least one aperture 214. As shown, wing lock 219 includes two locking extensions which matingly engage two apertures 214 in inner cam 209. Preventing rotation of inner cam 209 prevents rotation of inner cam driver 298, and thus also preventing rotation of outer knob/lever assembly 12. The locking catch assembly 215 securely engages aperture 28 and retains wing lock 219 in a locked orientation in a manner preventing "rapping" (unlocking by an impact force to the lock assembly). It should also be noted that lock plate 52 includes a curled tang portion 108 which wraps around the flange portion 231 of inner cam 209. This tang portion 108 provides additional support to the lock and significantly increases the lock load torque which lock architecture 210 is able to withstand.

As in the previous embodiment, rotation of the inside knob/lever assembly 12 will return lock architecture 210 to an unlocked state. Rotation of inside knob/lever assembly 12 causes rotation of spindle 236. As previously described, rotation of spindle 236 rotates main retractor 34 which engages retractor extensions 84 of slide 50. Movement of slide 50 retracts latch assembly 18, allowing the door to open. Movement of slide 50 also causes catch lock retraction extension 85 to depress locking catch 219 of locking catch assembly 215 such that locking catch 219 no longer engages aperture 28 of main retractor 34. This allows spring 213 to bias locking catch assembly 215 axially away from inner cam 209 and returning push button carrier 207 to an unlocked position under the biasing force of spring 213.

As with the previous embodiment, lock architecture 210 can also be used in a restoring configuration. When door latch assembly 18, 118, is configured with restore component 159 as previously described, depressing the bolt 94 results in movement of drawbar 88. This action causes slide 50 to move and, if the push button mechanism is locked, also causes catch lock retraction extension 85 to depress locking catch 219 of locking catch assembly 215 such that locking catch 219 no longer engages aperture 28 of main retractor 34. This allows spring 213 to bias locking catch assembly 215 axially away from inner cam 209 and returning push button carrier 207 to an unlocked position under the biasing force of spring 213.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A slide for a lock assembly comprising:

a drawbar having a pair of legs;

a U-shaped body portion;

a plurality of independent retractors; and a plurality of pairs of retaining slots positioned near an open end of said U-shaped body for attachmnent of a drawbar of a door latch assembly of said lock assembly, wherein said pair of legs matingly engage at least one pair of slots selected from the plurality of pairs of slots in said slide such that said slide provides multiple back set options for said door latch assembly.

2. The slide of claim 1 further comprising a second pair of retaining slots positioned near said open end of said slide and offset relative to said first pair of retaining slots.

3. The slide of claim 1 further comprising at least one self retaining spring slot.

4. The slide of claim 1 further comprising at least one cam surface.

5. The slide of claim 1, wherein said plurality of independent retractors are oriented in a co-planar relationship.

6. The slide of claim 1, wherein a rotational force applied to one of said retractors is converted to a linear movement of said slide.

7. The slide of claim 1 further comprising at least one push button lock bar retractor extending inward from said open end of said U-shaped body.

8. The slide of claim 1, wherein said slide comprises at least two push button lock bar retractors each extending inward from opposite sides of said open end of said U-shaped body.

9. A lock assembly for a door comprising:

a chassis assembly mounted in a bore of said door;

a door latch assembly operably connected to a slide member of said chassis assembly for retraction and extension of a bolt; and a handle mounted on a spindle on either side of said chassis assembly, wherein rotational motion imparted on one of said handles is converted to linear motion of said slide member within said chassis assembly at said slide interface in order to retract and extend said bolt of said door latch assembly, wherein said door latch assembly includes a drawbar operably connected to said bolt and having a pair of legs, and wherein said pair of legs matingly engage one pair of slots selected from a plurality of pairs of slots in said slide such that said slide provides multiple back set options for said door latch assembly.

10. The lock assembly of claim 9, wherein movement of said slide retracts said bolt to allow said door to be opened.

11. The lock assembly of claim 9, wherein movement of said slide disengages a locking feature of said chassis assembly.

12. The lock assembly of claim 9, wherein said slide comprises a U-shaped body which provides clearance along a rotational axis of said chassis assembly for other components of said chassis assembly.

13. The lock assembly of claim 9, wherein said slide comprises a plurality of independent retractors, wherein rotational movement against one of said retractors is converted to linear movement of said slide and retraction of said bolt.

14. The lock assembly of claim 13, wherein said slide is housed in a cage member of said chassis assembly and biased toward an open end of said cage, wherein rotational movement applied against at least one of said retractors causes said slide to move within said cage in a linear direction away from said open end of said cage causing retraction of said bolt.

15. The lock assembly of claim 13, wherein said slide further comprises at least one push button lock bar retractor extending inward from an open end of said slide, wherein said push button lock bar retractor disengages a rose locking mechanism of said lock assembly during movement of said slide.

16. The lock assembly of claim 15, wherein said slide comprises at least two push button lock bar retractors each extending inward from opposite sides of said open end of said slide.

* * * * *